US006593704B2

(12) United States Patent
Riepe et al.

(10) Patent No.: US 6,593,704 B2
(45) Date of Patent: Jul. 15, 2003

(54) METHOD AND BALLAST FOR FEEDING A UV LIGHT LOW PRESSURE RADIATOR

(75) Inventors: Dirk Riepe, Herford (DE); Jan Rudkowski, Hiddenhausen (DE)

(73) Assignee: Wedeco AG Water Technology, Düsseldorf (DE)

( * ) Notice: Subject to any disclaimer, the term of this patent is extended or adjusted under 35 U.S.C. 154(b) by 44 days.

(21) Appl. No.: 10/009,005

(22) PCT Filed: Feb. 9, 2001

(86) PCT No.: PCT/DE01/00519

§ 371 (c)(1),
(2), (4) Date: Dec. 4, 2001

(87) PCT Pub. No.: WO01/78465

PCT Pub. Date: Oct. 18, 2001

(65) Prior Publication Data

US 2003/0057868 A1 Mar. 27, 2003

(30) Foreign Application Priority Data

Apr. 6, 2001 (DE) ..... 100 16 982

(51) Int. Cl.[7] ..... H05B 37/00
(52) U.S. Cl. ..... 315/224; 315/237; 315/238
(58) Field of Search ..... 315/224, 209 R, 315/237, 238

(56) References Cited

U.S. PATENT DOCUMENTS

| | | | | |
|---|---|---|---|---|
| 4,408,141 A | | 10/1983 | Byszewski et al. | |
| 5,187,413 A | | 2/1993 | Araki et al. | |
| 5,357,173 A | * | 10/1994 | Kachmarik et al. | 315/209 R |
| 5,698,952 A | | 12/1997 | Stebbins | |
| 5,994,849 A | | 11/1999 | Vollkommer et al. | |

FOREIGN PATENT DOCUMENTS

| | | |
|---|---|---|
| DE | 3607109 | 5/1987 |
| DE | 4401630 | 7/1995 |
| DE | 19627703 | 1/1998 |
| DE | 19642947 | 4/1998 |

* cited by examiner

*Primary Examiner*—David Hung Vu
(74) *Attorney, Agent, or Firm*—Collard & Roe, P.C.

(57) ABSTRACT

The invention relates to a method and a ballast for feeding a UV light low pressure radiator. The UV light low pressure radiator is ignited and subsequently fed with direct current. The polarity of the direct current is changed at successive intervals which are greater than half the period of the conventional network frequency and smaller than a time until a lower threshold value for the operational temperature of the electrodes is reached, whereby said time is a result of the thermal time constant of the UV light low pressure radiator.

19 Claims, 3 Drawing Sheets

METHOD AND BALLAST FOR FEEDING A UV LIGHT LOW PRESSURE RADIATOR

CROSS REFERENCE TO RELATED APPLICATIONS

Applicants claim priority under 35 U.S.C. §119 of GERMAN Application No. 100 16 982.1 filed on Apr. 6, 2000. Applicants also claim priority under 35 U.S.C. §120 of PCT/DE01/00519 filed on Feb. 9, 2001. The international application under PCT article 21(2) was not published in English.

The invention relates to a process for supplying energy to a low-pressure UV irradiation lamp in accordance with the preamble of claim 1 and a ballast for supplying energy to a low-pressure UV irradiation lamp in accordance with the preamble of claim 7.

Methods for disinfecting water by means of UV light are making use of increasingly powerful low-pressure irradiation lamps. Requirements in terms of effectiveness and adjustability are very high.

Whereas gas discharge lamps for purposes of lighting function mostly with simple ballasts containing passive components and receive their energy directly from the low-voltage mains at the normal mains frequency of 50 to 60 Hz, powerful low-pressure UV irradiation lamps for water disinfection are operated with electronic ballasts and at mains frequencies >20 KHz. Operating at a considerably higher frequency than the normal mains frequency has the advantage that passive components used, such as inductors and capacitors, can be smaller in terms of size and weight. In addition, the ionization of the gas discharge arc is not lost after zero crossover of the radiation current when the polarity changes, whereas at the normal mains frequency, ionization is interrupted by ion recombination at every zero crossover of the radiation current, so that the low-pressure UV irradiation lamp has to be restarted after every zero crossover.

On the other hand, the disadvantages of operating at frequencies >20 KHz include the presence of perturbing radiation and line losses over longer line distances between the ballast and the low-pressure UV irradiation lamps. Both of these disadvantages are also particularly significant in applications related to the water disinfection, for as the power of the UV lamp is increased, so too does the perturbing radiation. Moreover, specifically in water treatment applications, whole batteries of low-pressure UV irradiation lamps are used in a limited space. If it is not possible to deploy the ballasts in this space as well, appropriate provision must be made for long energy supply lines.

In the case of gas discharge lamps for lighting purposes, it is known from DE 36 07 109 C1, DE 44 01 630 A1 or DE 196 42 947 A1 to avoid strobe effects and flickering at the mains frequency, and to reduce alternating electromagnetic fields by the use of direct current. However, since operation exclusively with direct current leads to electrophoretic effects that cause the contents of the lamp to be deposited on the interior surface of the lamp glass and the electrodes, and a corresponding loss of light output, the polarity in gas discharge lamps is reversed from time to time. Intervals of between 15 and 30 minutes are indicated for this.

It has been demonstrated that when these measures used in gas discharge lamps for lighting are applied to low-pressure UV irradiation lamps, both the operating life and the irradiating performance of such irradiation lamps are severely degraded.

The object of the present invention is to simplify the energy supply required for operating low-pressure UV irradiation lamps, to increase the UV light output and to improve efficiency without shortening the operating life.

This object is solved in a process according to the preamble of claim 1, by the characterizing portion of that claim, and in a ballast according to the preamble of claim 7, and the characterizing portion of that claim.

Improvements and advantageous configurations of the invention are described in the subordinate claims.

A partial solution to the process according to invention consists in known manner of operating the low-pressure UV irradiation lamp with direct voltage or direct current. This eliminates all the disadvantages associated with and alternating voltage or alternating current energy supply, that is to say for mains frequency energy supply the constant restriking of the gas discharge arc at the mains frequency with the consequentially increased electrode wear, and for high-frequency energy supply >20 KHz, perturbing radiation and short lengths of energy supply lines or line losses. This also prevents mismatching between applied voltage and the optimum UV light capacity, such as occurs when operating with alternating voltage or alternating current, since the operating point corresponding to an optimum light yield is only cycled through briefly as the voltage changes in time.

The direct voltage operation with polarity switching at intervals known from gas discharge lamps for lighting purposes would require repeated preheating of the electrodes after each change of polarity in the case of low-pressure UV irradiation lamps. The act of preheating every 15 to 30 minutes would itself be sufficient to reduce the operating life severely. Since considerably higher radiation output is produced by low-pressure UV irradiation lamps for disinfecting water by ultraviolet light than by gas discharge lamps for lighting, and power consumption is accordingly significantly higher, the effects of electrophoresis would also become evident considerably sooner. In order to avoid the disadvantageous effects of electrophoresis, the polarity would have to be reversed at shorter intervals, and this again would drastically shorten the operating life due to the need for repeated preheating or the power load on the cooled electrodes in the case of insufficient preheating.

The dilemma described in the foregoing is resolved in the first instance by the further measure according to the invention of setting the intervals for polarity reversal to a time shorter than the time required to reach a lower threshold value for the operating temperature of the electrodes, as determined by the thermal time constant of the low-pressure UV irradiation lamp. If this determination rule is observed, the cooling electrode in each case is still at its operating temperature at the time of polarity reversal and after the polarity reversal can then assume the function of the electrode previously kept at the operating temperature without repeated preheating or wear due to excessive power loading. In this way, the advantages of direct current operation are exploited and at the same time the effects of electrophoresis and electrode wear as a result of overfrequent preheating or power loading of the electrode that has already cooled to below the operating temperature are avoided.

The switching of the polarity does not constitute conventional alternating current operation, because the switching frequency per unit of time is smaller than the lowest frequency that was formerly in common use with alternating current operation, the mains alternating current of 50 to 60 Hz. The polarity reversal also does not correspond to the zero crossover of the harmonic, particularly sinusoidal oscillation of the mains alternating current, but rather to the polarity reversal that takes place during the switching transition period, the voltage of which has at least the value of the arc drop voltage. Otherwise the low-pressure UV irradiation lamp would go out considerably before the polarity reversal, because some time would still elapse after the applied voltage dropped below the arc drop voltage value and before it finally reached the zero value.

The time intervals between polarities changes can be set to longer than 0.2 seconds but shorter than 5 seconds.

Thus, the intervals between polarity reversals are considerably longer than the period of the normal mains frequency, so difficulties from perturbing radiation will not arise and there is no risk of contravening electromagnetic compatibility regulations.

At the same time, the intervals are also shorter than the time it takes for the electrode to become cooler than the operating temperature. The thermal time constant of the low-pressure UV irradiation lamp indicated for this purpose is calculated on the basis of the combined thermal time constants for the electrodes, the gas-phase contents of the lamp, and the lamp housing and may vary from lamp to lamp. It is therefore not possible to specify an exact threshold value. It is also possible to provide for cooling below the operating temperature at the expense of the operating life of the low-pressure UV irradiation lamp. To compensate for this, a higher voltage must be applied, but this may still be below the initiation voltage. However, the greater the value by which the operating voltage is undersupplied, the greater is the power loading on the electrode, since material is torn from the surface of the affected electrode each time the polarity is reversed, and this shortens the operating life of the electrode.

The lamp voltage or the lamp current can also be monitored after a polarity change and if the electrical power deviates from a reference value, the polarity can be reversed again.

This provision ensure that the low-pressure UV irradiation lamp never operates for too long without a polarity reversal and thus avoids possible damage from the effects of electrophoresis.

The threshold value is preferably set 3% lower than the output value at the beginning of a polarity reversal.

This value, which is about 10% of the variable value assuming constant voltage and variable current or constant current and variable voltage, does not cause an apparent loss of UV output. With regard to electrophoretic effects, this is then also an initiating stage, which is still reversible after immediate polarity change, so that there is not deleterious effect on the operating life.

It is practical to establish monitoring intervals for measuring output that are shorter than the thermal time constant for the low-pressure UV irradiation lamp.

This ensures that electrophoresis effects are still detected even if they occur before the polarity reversal, the timing of which is determined on the basis of the thermal time constant of the low-pressure UV irradiation lamp.

The transition time, during which the polarity is reversed, can be set to be shorter than the recombination time for the gas discharge arc of the low-pressure UV irradiation lamp.

This provision ensures that during the transition from one polarity to the other and the change from negative to positive or from positive to negative of the value of the steady state direct voltage, the gas discharge arc is not extinguished by recombination of the gas ions that form it, so that it needs to be restruck. If an appropriately short time is set, the ionization of the gas discharge arc is not lost, so that may be retained without repeated ignition and can continue to be used to generate UV light.

The operating procedure according to the invention described with reference to the process and the advantages of the improvements apply also to the ballast. In a further improvement of the ballast, the switch is configured from four static switches in a ring arrangement that are powered with direct voltage or direct current at two opposing nodes. A bridge arm includes the low-pressure UV irradiation lamp. Two diagonally opposed static switches are opened and closed in alternating sequence with the other two opposing static switches.

This provides for steady state operation between the switching phases, and also means that the switching time when the polarity is reversed is very short.

In a further enhancement, at least one closable static switch in each pair may take the form of a controllable source of electric power.

This configuration has the advantage that a direct voltage source that is exclusively voltage-controlled can be used as the power source for the entire arrangement. The arc drop voltage of the lamp can be set here. The controllable or adjustable power sources that are present in each active branch of the circuit serve to compensate for lamp tolerances and environmentally-conditioned variations in, the electrical operating parameters of the low-pressure UV irradiation lamp.

In a further embodiment of the ballast according to the invention, the initiation device includes a series connection consisting of an inductor and a capacitor that is disposed between the electrodes of the low-pressure UV irradiation lamp. Prior to initiation, this serial connection may be connected to an alternating voltage or alternating current energy source such that it may be disconnected therefrom for initiation.

In this embodiment, the voltage source does not have to provide the initiation voltage, and can be in the normal range for the arc drop voltage. The initiation voltage is generated when the current flowing in the inductor in the series connection initially cannot continue to flow in a closed electrical circuit when the static switches are opened, which leads to a voltage buildup, and this in turn provides the initiation voltage via the parallel connection to the discharge area of the low-pressure UV irradiation lamp. After initiation, the system switches to the steady state, in which each pair of diagonally opposed static switches in the ring arrangement is alternately closed or opened to complete the connection between the low-pressure UV irradiation lamp and the voltage or current source.

The serial connection consisting of an inductor and a capacitor can also be arranged in series as a heating coil for the electrodes of the low-pressure UV irradiation lamp, and in this arrangement the alternating current applied prior to initiation is used at the same time to preheat the heating coil.

Heating coils of this nature are quite essential for amalgam-doped low-pressure UV irradiation lamps, since without them initiation cannot take place. The improvement means that the electrical circuit can be used in alternating voltage mode to heat the heating coil—with current limiting assured by the inductor and the capacitor—and to initiate the low-pressure UV irradiation lamp by means of the inductor.

An alternative embodiment of the initiation device may include a capacitor that is arranged between the electrodes of the low-pressure UV irradiation lamp. A direct voltage rising to the initiation voltage is applied to the electrodes before initiation. After initiation, and when the voltage has fallen to the arc drop voltage level, a filter capacitor is switched on by a static switch.

By rectifying the low-frequency alternating voltage from the mains supply to provide direct voltage, the filter capacitor then serves to attenuate a pulsing direct voltage component. The filter capacitor, which is larger than the initiation capacitor because of its rating for the low capacitance frequency, may be selected to have lower electric strength than the initiation capacitor because it can be switched off. The initiation capacitor is constantly parallel to the low-pressure UV irradiation lamp and must be rated for the initiation voltage.

In a serial connection of multiple low-pressure UV irradiation lamps, the initiation device can additionally include several capacitors in series that for their part are each arranged in parallel with the low-pressure UV irradiation lamps. At the same time, an embodiment of the capacitive voltage distributor may be provided with the same or different capacitors.

If the same capacitors, and consequently the same distribution ratio, are used, the initiation voltage that can be applied to the serial connection of low-pressure UV irradiation lamps and parallel capacitors at least reaches a value corresponding to the initiation voltage of the most easily initiated low-pressure UV irradiation lamp multiplied by the number of low-pressure UV irradiation lamps connected in series.

Then, when a low-pressure UV irradiation lamp has been initiated, its voltage drops to the lower arc drop voltage, so that the applied voltage is then distributed at an accordingly higher level among the low-pressure UV irradiation lamps that have not yet been initiated. These low-pressure UV irradiation lamps are then initiated almost simultaneously, for as each subsequent low-pressure UV irradiation lamp is initiated the voltage applied to the remaining low-pressure UV irradiation lamps is increased, so that even the most reluctant low-pressure UV irradiation lamps, which require a higher initiation voltage than their counterparts, are forced to initiate rapidly.

In an embodiment with dissimilar capacitors or in which one capacitor is actually missing, resulting in an unbalanced distribution ratio, the maximum initiation voltage can be limited to a value that only marginally exceeds the necessary initiation voltage for a single low-pressure UV irradiation lamp. The major portion of the initiation voltage on the serial connection is applied in the first instance only to the first low-pressure UV irradiation lamp, which is initiated accordingly.

The initiation voltage, less the arc drop voltage for the initiated lamp is distributed in the distribution ratio of the remaining capacitive voltage distributor to the remaining low-pressure UV irradiation lamps, of which one more receives a major proportion of the initiation voltage, and is initiated. This procedure is repeated in like manner until all the low-pressure UV irradiation lamps are initiated.

The supply voltage for the ballast may be variable, and in the case of multiple low-pressure UV irradiation lamps connected in series, may be adjusted for the sum of individual voltages for the low-pressure UV irradiation lamps.

This solution enables not just one low-pressure UV irradiation lamp, but serial connections of various numbers of low-pressure UV irradiation lamps to be driven by one ballast without the need for any changes to the ballast. Indeed the economic viability of the ballast is significantly increased if several low-pressure UV irradiation lamps are driven by the same ballast.

The invention will be described in the following with reference to the exemplary embodiments illustrated in the drawings, in which.

Figure 1:
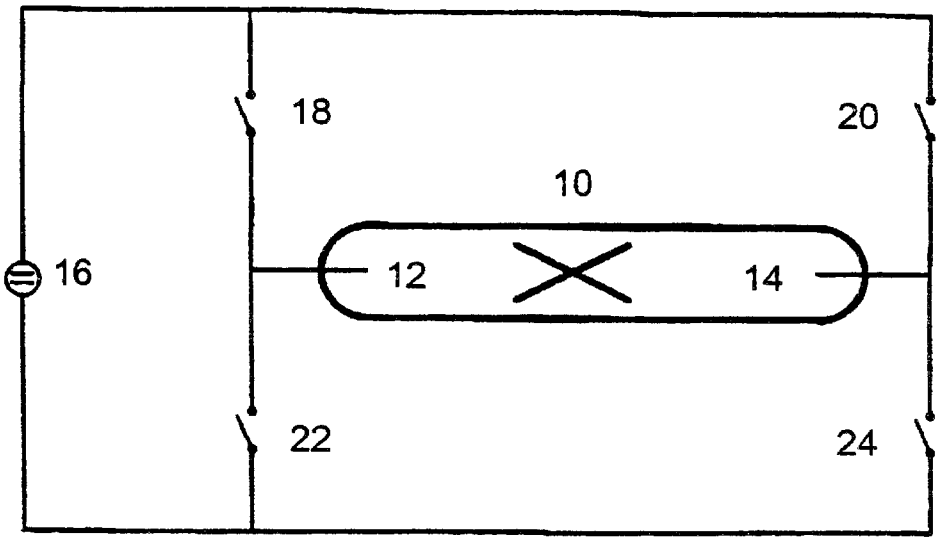
FIG. 1 shows a basic circuit for a ballast with static switches.

The ballast shown in various modified versions in the drawings is designed to supply a low-pressure UV irradiation lamp 10 with electrical energy from a voltage source 16.

Figure 2:
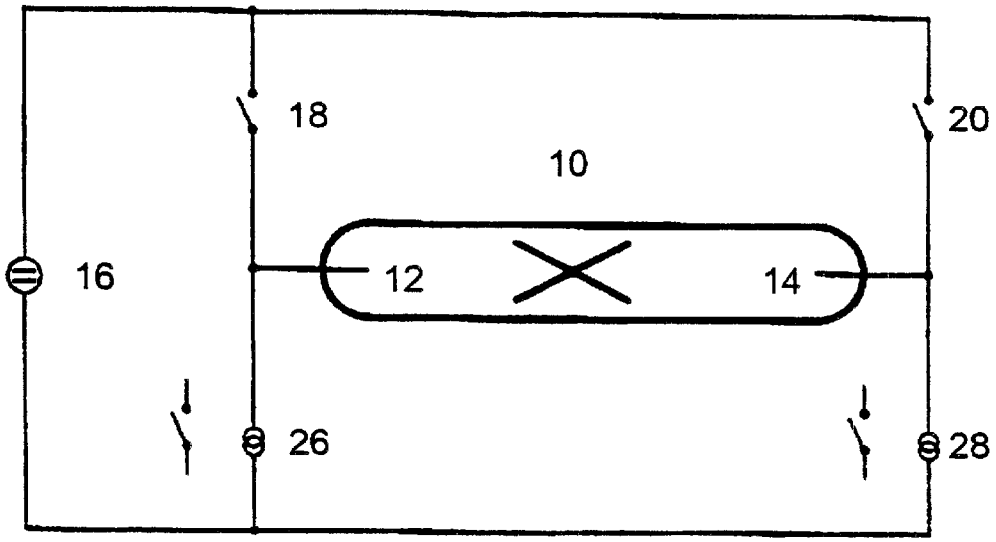
FIG. 2 shows an alternative embodiment of FIG. 1, in which two switches are replaced with controllable energy sources.

Voltage source 16 in FIGS. 1 and 2 is a direct voltage source that loads electrodes 12 and 14 of low-pressure UV irradiation lamp 10 with constant voltage. Static switches 18, 20, 22 and 24 are provided in order to effect periodic reversals of polarity. Static switches 18, 20, 22 and 24 form a ring, to one node of which, between static switches 18 and 20 or 22 and 24, voltage source 16 is connected, and to the other node of which, between static switches 18 and 22 or 20 and 24, that is to say diagonal to the ring, low-pressure UV irradiation lamp 10 with its electrodes 12 and 14 is connected.

The static switches are controlled in such manner that one pair of static switches 18 and 24 is always closed when the other pair of static switches 20 and 22 is open, and vice versa. The time intervals at which each pair of static switches is open and the other pair closed is determined on the basis of the thermal inertia of low-pressure UV irradiation lamp 10, and may be between 0.2 and 5 seconds. In practice, this interval is about 0.5 seconds. During this interval, electrodes 12 and 14 are under constant direct voltage or constant direct current, the polarity of which is reversed regularly and according to the same interval as the opening and closing of the switches.

The illustration in FIG. 1 shows the steady state in which a gas discharge arc is already present in the low-pressure UV irradiation lamp.

In the diagram according to FIG. 1, the voltage from voltage source 16 must correspond within very strict tolerances with the arc drop voltage of the low-pressure UV irradiation lamp 10 without further power governing means.

FIG. 2 shows a diagram similar to FIG. 1, except that controllable energy sources 26 and 28 are used instead of static switches 22 and 24. These assume not only the function of static switches 22 and 24 as shown in FIG. 1, but also that of governing the energy. The need for a narrowly toleranced direct voltage source 16 is therefore no longer necessary. Direct voltage source 16 can be rated for the maximum arc drop voltage instead, since energy sources 26 and 28 govern the supplied energy at a permissible value in the event of variations in the operating parameters, the effects of aging, or changes in the tolerances of the low-pressure UV irradiation lamp 10.

The diagrams in FIGS. 1 and 2 have been concerned only with the steady state, in which it is assumed that low-pressure UV irradiation lamp 10 is already in operation. However, in order to bring the low-pressure UV irradiation lamp to a functioning state, a further means is necessary because an initiation voltage is needed that is higher than the arc drop voltage.

Figure 3:
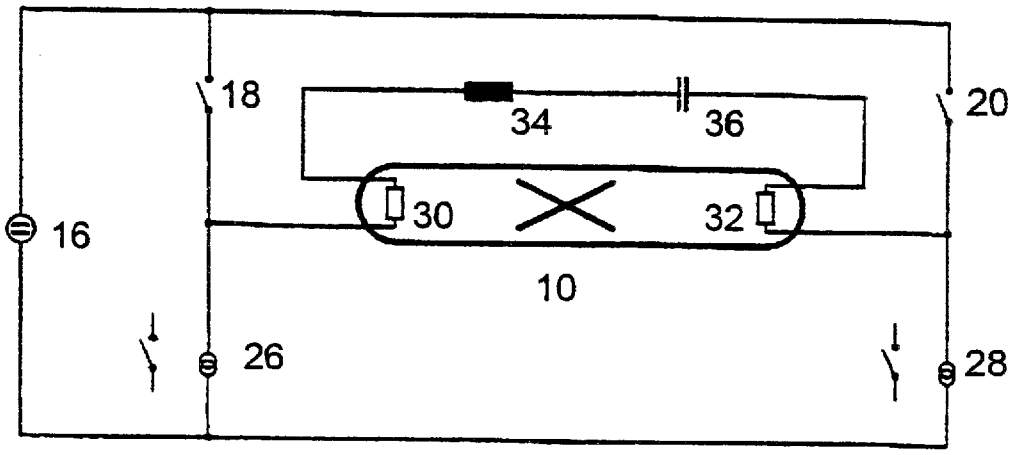
FIG. 3 shows a circuit according to FIG. 2, but with the addition of an initiation device.

High output low-pressure UV irradiation lamps also need to have preheating applied to their electrodes so that initiation is easier, or indeed possible in some cases. The diagram in FIG. 3 shows a solution thereto that provides for heating for the electrodes and initiation.

The present figure thus represents a practically realizable embodiment.

In the low-pressure UV irradiation lamp 10 being used, the electrodes are configured as heating coils 30 and 32. A heating circuit runs from the nodal points between static switch 18 and controllable energy source 26 and between static switch 20 and controllable energy source 28 through the serial connection consisting of an inductor 34 and a capacitor 36. For preheating, low-pressure UV irradiation lamp 10 is first driven with alternating voltage. This can be achieved by providing that voltage source 16 itself generates alternating voltage, or that voltage source 16 functions as a source of direct voltage and alternating voltage is created by alternate switching of switches 18 and 20 with upward or downward adjustment of power sources 26 and 28. This assumes a sinusoidal low to medium frequency alternating voltage.

This alternating voltage allows a current to flow through heating coils 30 and 32 and which is governed by a serial connection that serves as a dropping resistor for alternating voltage and consists of inductor 34 and capacitor 36. Since in this preheating mode the inductor 34 and the capacitor 36 store energy alternately, the serial connection can also be used to help with initiation.

At the point of initiation, switches 18 and 20 are open and controllable power sources 26 and 28 are blocked so that the energy stored in inductor 34 causes the voltage to rise at coils 30 and 32, which now function as electrodes, thereby initiating the low-pressure UV irradiation lamp 10 when the initiation voltage is reached. A gas discharge arc is then formed inside low-pressure UV irradiation lamp 10. Once the gas discharge arc has been formed, the circuit switches to the steady state, during which switch 18 and controllable energy source 28 are opened and closed in alternation with switch 20 and controllable energy source 26. Since low-pressure UV irradiation lamp 10 is then operated with direct current, the serial connection consisting of inductor 34 and capacitor 36 does not form a shunt.

Figure 4:
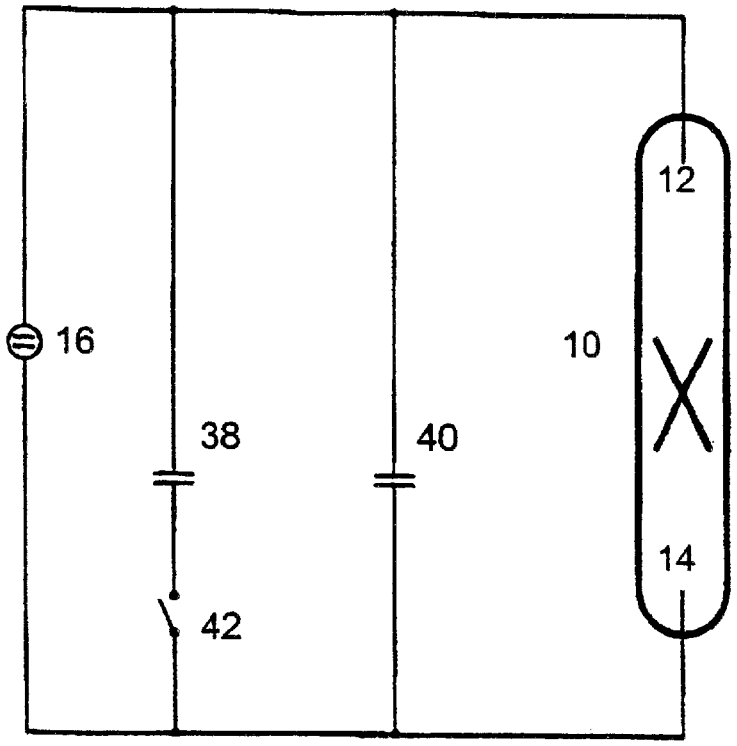
FIG. 4 shows a further alternative for an initiation device and FIG. 5 shows an initiation device for a serial connection of low-pressure UV irradiation lamps.

FIG. 4 illustrates a further alternative for an initiating device, consisting of two capacitors 38 and 40 arranged in parallel with low-pressure UV irradiation lamp 10. In this instance, capacitor 38 serves as the main filter capacitor, and capacitor 40 is an initiation capacitor. Main filter capacitor 38 can be switched into or out of the circuit in parallel by means of static switch 42. Initiation is achieved in that direct voltage source 16 first raises the voltage at initiation capacitor 40 until the initiation voltage level is reached. After initiation, main filter capacitor 38 is switched on in parallel by means of static switch 42. Main filter capacitor 38 only needs to have a voltage strength sufficient for the arc voltage drop of low-pressure UV irradiation lamp 10.

Figure 5:
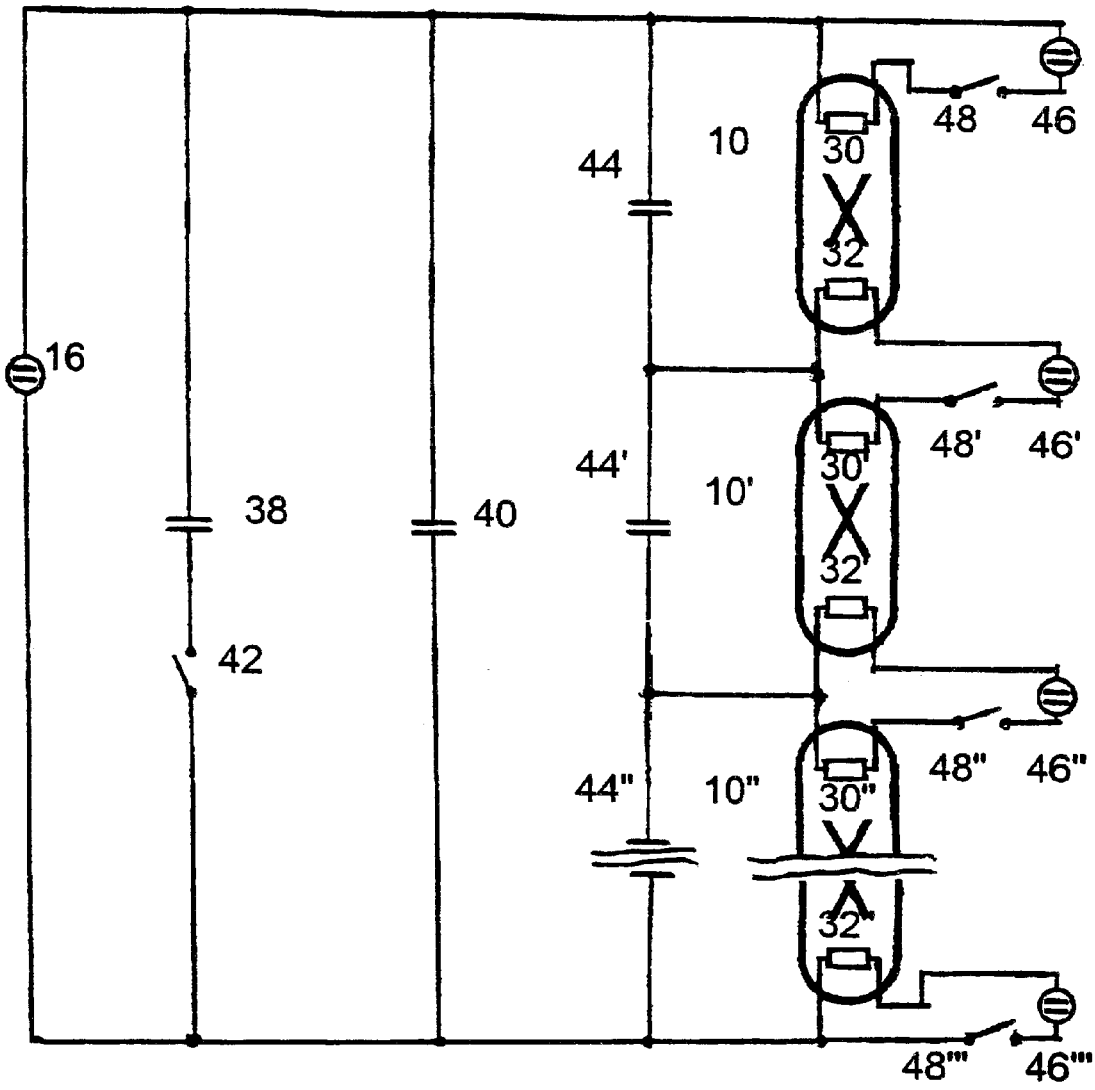

FIG. 5 illustrates an initiation device for a serial connection of low-pressure UV irradiation lamps. The configuration is based on the circuit shown in FIG. 4, except that several low-pressure UV irradiation lamps 10, 10' and 10" are connected in series and the frame line indicates that the serial connection may also include more low-pressure UV irradiation lamps than the three shown 10, 10', 10". The initiation device includes a serial connection of capacitors 44, 44', and 44", which are themselves arranged parallel to low-pressure UV irradiation lamps 10, 10' and 10". In this way, a voltage distributor is created that applies initiation voltage to the associated low-pressure UV irradiation lamps 10, 10' and 10" in the voltage distributor's distribution ratio.

As soon as the first low-pressure UV irradiation lamp has been initiated, either the one with the lowest initiation voltage upon reception of an equal distribution ratio, or the one receiving the major share of the applied initiation voltage upon reception of an unequal distribution ratio, and its voltage share returns for the arc drop voltage, the voltage shares at the remaining capacitors and low-pressure UV irradiation lamps are increased correspondingly, and these are then initiated in very quick succession if not practically simultaneously.

For preheating, voltage sources 46, 46' and 46", and 46'" are provided, which can heat electrode coils 30, 30', 30", and 32, 32', and 32" either singly or in pairs. Since heating is no longer necessary when the lamp is burning, voltage sources 46, 46' and 46", and 46'" may be switched off by switches 48, 48' and 48", and 48'" after the corresponding low-pressure UV irradiation lamp 10, 10' and 10" has been initiated.

What is claimed is:

1. A process for supplying energy to a low-pressure UV irradiation lamp (10) with a voltage or current of reversing polarity, characterized in that after initiation of the low-pressure UV irradiation lamp (10) the time intervals at which the polarity is reversed are set to be longer than half the period of the normal mains frequency but shorter than a time taken to cool to a lower limit of the operating temperature for electrodes (12, 14), calculated on the basis of the thermal time constant of the low-pressure UV irradiation lamp (10).

2. The process according to claim 1, characterized in that the intervals are longer than 0.2 seconds but shorter than 5 seconds.

3. The process according to claim 1, characterized in that the lamp voltage or the lamp current are monitored after a polarity reversal, and the polarity is reversed again if the electrical output deviates from a reference value.

4. The process according to claim 3, characterized in that the threshold value is advantageously 3% below the output value at the start of a polarity reversal.

5. The process according to claim 3, characterized in that the monitoring intervals for the measurement of output are set to be shorter than the thermal time constant of the low-pressure UV irradiation lamp (10).

6. The process according to claim 1, characterized in that the transition time, in which the polarity is reversed, is set to be shorter than recombination time for the gas discharge arc of the low-pressure UV irradiation lamp (10).

7. A ballast for supplying energy to a low-pressure UV irradiation lamp (10), consisting of an initiation device and a power supply device for steady state operation, including a direct current source or a direct voltage source (16) the polarity of which can be reversed by means of a switching arrangement (18, 20, 22, 24), which switching arrangement (18, 20, 22, 24) can be regulated by a controller, characterized in that the size of the controller is such that the time intervals after which the polarity is reversed is longer then half the period of the normal mains frequency but shorter than a time taken to cool to a lower limit of the operating temperature for electrodes (12, 14), calculated on the basis of the thermal time constant of the low-pressure UV irradiation lamp (10).

8. The ballast according to claim 7, characterized in that the controller has a size such that the time intervals after which polarity is reversed are longer than 0.2 seconds but shorter than 5 seconds.

9. The ballast according to claim 7, characterized in that a device is provided for monitoring the lamp voltage or the lamp current after a change of the polarity and that a signal is transmitted to the controller to reverse the polarity again if the electrical output deviates from a reference value.

10. The ballast according to claim 9, characterized in that the threshold value is preferably 3% below the output value at the start of a polarity reversal.

11. The ballast according to claim 9, characterized in that the monitoring intervals for the measurement of output are set to be shorter than the thermal time constant of the low-pressure UV irradiation lamp (10).

12. The ballast according to claim 7, characterized in that the switching time of the controller in which the polarity is reversed, is set to be shorter than recombination time for the gas discharge arc of the low-pressure UV irradiation lamp (10).

13. The ballast according to claim 7, characterized in that the switch arrangement has the form of a ring arrangement consisting of four static switches (18, 20, 22, 24), which is connected to a direct current or direct voltage source 16) at two opposing nodal points, includes a bridge arm with the low-pressure UV irradiation lamp (10), and in which each of two diagonally opposed static switches (18, 24; 20, 22) are openable and closable in alternating sequence with the two other diagonally opposed static switches (20, 22; 18, 24).

14. The ballast according to claim 7, characterized in that at least one of the static switches that is closable at the same time is configured as a controllable energy source (26, 28).

15. The ballast according to claim 7, characterized in that the initiation device includes a serial connection consisting of an inductor (34) and a capacitor (36) that is arranged between the electrodes (30, 32) of the low-pressure UV irradiation lamp (10), is connectable to an alternating current or alternating voltage source (10) prior to initiation and is disconnectable from the alternating current or alternating voltage source (10) for the initiation.

16. The ballast according to claim 15, characterized in that the serial connection consisting of an inductor (34) and a capacitor (36) is arranged in series with heating coils (30, 32) of the electrodes of the low-pressure UV irradiation lamp (10) and the alternating current applied prior to initiation serves to preheat the heating coils (30, 32) at the same time.

17. The ballast according to claim 7, characterized in that the initiation device includes a capacitor (40) that is arranged between the electrodes (12, 14) of the low-pressure UV irradiation lamp (10), that a direct voltage increasing to the value of the initiation voltage can be applied prior to initiation and that after initiation a filter capacitor (38) can be switched in by means of a static switch (42).

18. The ballast according to claim 7, characterized in that the initiation device in a serial connection of multiple low-pressure UV irradiation lamps (10, 10', . . . 10") also include a serial connection of capacitors (44, 44' . . . 44"), which themselves are each arranged in parallel to the low-pressure UV irradiation lamps (10, 10', . . . 10") and form a capacitive voltage distributor with equal or unequal voltage ratio for the initiation voltage.

19. The ballast according to claim 7, characterized in that the supply voltage is variable and can be adjusted to match the sum of individual voltages for low-pressure UV irradiation lamps (10, 10', . . . 10") when several low-pressure UV irradiation lamps (10, 10', . . . 10") are connected together in series.

* * * * *

UNITED STATES PATENT AND TRADEMARK OFFICE

CERTIFICATE OF CORRECTION

PATENT NO. : 6,593,704 B2
DATED : July 15, 2003
INVENTOR(S) : Riepe et al.

It is certified that error appears in the above-identified patent and that said Letters Patent is hereby corrected as shown below:

Title page,
Item [30], Foreign Application Priority Data, correctly should read:
-- Apr. 6, 2000 (DE) …….. 100 16 982 --.

Signed and Sealed this

Fourth Day of November, 2003

JAMES E. ROGAN
*Director of the United States Patent and Trademark Office*